US010531750B1

(12) United States Patent
Heiden et al.

(10) Patent No.: US 10,531,750 B1
(45) Date of Patent: Jan. 14, 2020

(54) TWO-PIECE CORRUGATED SHELVING DISPLAY WITH TWO-PANEL SHELVES

(71) Applicant: Green Bay Packaging, Inc., Green Bay, WI (US)

(72) Inventors: Chad Heiden, Hartford, WI (US); Michael Bagatta, Grafton, WI (US)

(73) Assignee: Green Bay Packaging, Inc., Green Bay, WI (US)

( * ) Notice: Subject to any disclaimer, the term of this patent is extended or adjusted under 35 U.S.C. 154(b) by 221 days.

(21) Appl. No.: 15/621,190

(22) Filed: Jun. 13, 2017

Related U.S. Application Data

(60) Provisional application No. 62/350,475, filed on Jun. 15, 2016.

(51) Int. Cl.
*A47F 5/11* (2006.01)
*A47F 5/00* (2006.01)

(52) U.S. Cl.
CPC ..... *A47F 5/116* (2013.01); *A47F 5/0018* (2013.01)

(58) Field of Classification Search
CPC ..... A47F 5/116; A47F 5/0018; A47F 5/11; A47B 43/02; A47B 47/06
See application file for complete search history.

(56) References Cited

U.S. PATENT DOCUMENTS 1,124,175 A * 1/1915 Sackett ..... A47B 3/10 108/59
3,860,305 A * 1/1975 Bergman ..... A47B 43/02 229/162.1
3,877,396 A * 4/1975 Patterson ..... A47B 47/06 108/183
6,612,669 B2 * 9/2003 Grueneberg ..... A47B 43/02 108/165
6,715,623 B2 * 4/2004 Broerman ..... A47F 5/116 211/149
8,485,370 B2 * 7/2013 Dewhurst ..... A47F 5/116 211/135
8,857,633 B2 10/2014 Dewhurst
9,474,389 B2 10/2016 Pfeifer et al.
9,743,783 B1 * 8/2017 Bersamin ..... A47F 5/116
10,123,635 B2 * 11/2018 Lilja ..... A47B 43/02
2004/0016375 A1 * 1/2004 Grueneberg ..... A47B 43/02 108/115
2004/0148825 A1 * 8/2004 Myers ..... A47F 5/116 40/124
2008/0169339 A1 * 7/2008 Moser ..... B65D 5/5213 229/108.1
2010/0181443 A1 * 7/2010 Bojie ..... A47F 5/11 248/146
2014/0014606 A1 * 1/2014 Mestres Armengol ..... A47F 5/116 211/135
2015/0068998 A1 * 3/2015 Smith ..... A47F 5/116 211/135
2017/0231404 A1 * 8/2017 Pratsch, Jr. ..... A47B 43/02 211/135

(Continued)

*Primary Examiner* — Ko H Chan
(74) *Attorney, Agent, or Firm* — Boyle Fredrickson, S.C.

(57) ABSTRACT

A collapsible shelving display that can be shipped and stored in a generally flat configuration and folded into an erected display configuration formed of a first and second blank of affixed material. The collapsible display includes a series of shelf surfaces formed of a front shelf portion extending from the first blank of material and a rear shelf portion extending from the second blank of material.

22 Claims, 15 Drawing Sheets

(56) References Cited

U.S. PATENT DOCUMENTS

| | | | | |
|---|---|---|---|---|
| 2017/0245661 | A1* | 8/2017 | Heuer | A47B 43/00 |
| 2018/0160825 | A1* | 6/2018 | Abel | A47F 5/116 |
| 2018/0289178 | A1* | 10/2018 | McMillan-Sweat | A47F 5/116 |
| 2019/0069694 | A1* | 3/2019 | Smith | A47F 5/116 |

* cited by examiner

TWO-PIECE CORRUGATED SHELVING DISPLAY WITH TWO-PANEL SHELVES

CROSS-REFERENCE TO RELATED APPLICATION

This application claims the benefit of U.S. Ser. No. 62/350,475 filed Jun. 15, 2016, the disclosure of which is incorporated herein in its entirety.

BACKGROUND OF THE INVENTION

1. Field of the Invention

The present invention relates to a shelving display, and more particularly a collapsible shelving display formed from two pieces of corrugated board.

2. Background

Temporary product displays and mobile product displays are becoming increasing common place in retailer environments. Such displays are often installed to promote the sale of temporary or seasonal products. However, such displays, which, may include integrated product shelving often include multiple pieces that have to be joined together, rendering them more difficult to ship and, assemble. Accordingly, there is need for a shelving display that may be easily assembled in retail locations without significant installation training.

Additionally, due to the temporary nature of such displays, they are often formed of inexpensive materials such as corrugated board. However, the, assembly of a display that includes multiple independent pieces of corrugated board being folded into a single display unit can be prone to misfolding, tearing, and bending; all of which may reduce the structural integrity of the assembled display. Accordingly, there is need for a shelving display formed of a disposable or recyclable corrugated board with reinforced shelves that can support the weight of retail products.

There is also need for a shelving display that is collapsible for both ease of transportation, e.g., shipping, and storage when not in use. There is also need for a shelving display that can be formed of relatively low cost materials, such as corrugated board, which may also be recycled when use of the display is complete.

BRIEF DESCRIPTION OF THE INVENTION

By way of summary, in accordance with one aspect, the present invention solves one more of the above-referenced needs by providing a collapsible display that includes a series of easily assembled shelves. The display of the present invention may he formed of first and second blanks of material, which are affixed to one another and configured to transition between a generally flat configuration and an erected configuration. The present invention provides a display that is particularly well suited for transportation and storage in a generally fiat configuration, and for use in an erected configuration via folding portions of the first and second blanks without adhesive, fasteners or the like to maintain the display in the erected configuration. The present invention may also provide a display that is particularly well suited for repeatedly transitioning between the flat configuration and the erected configuration, but may also be recycled when use of the display is complete.

In one embodiment of the present invention, the display may include a first blank of material that defines a series of outer panels of the display and a series of front shelf portions, which is affixed to a second blank of material that defines a series of rear shelf portions. The front shelf portions may respectively engage corresponding rear shelf portions to define a series of shelf surfaces, the shelf surfaces having a surface area substantially equal to a cross sectional area of the display when it is in the erected configuration.

In another embodiment, the second blank of material may include a series of collapsible corner braces, where an upper edge of each collapsible corner brace is configured to engage a lower surface of a corresponding rear shelf portion when the display is in the erected configuration.

In another embodiment, the second blank of material may include a series of ribs extending from a first side of the display to an opposing second side of the display, where an upper edge of each rib is configured to engage a lower surface of a corresponding rear shelf portion when the display is in the erected configuration.

In another embodiment, the collapsible display has a depth between a rear panel and a front panel, and the series, of ribs are asymmetrically positioned between the rear panel and the front panel.

In another embodiment, a tab may extend from each of the front shelf portions and pass through a void in each of the corresponding rear shelf portions and engages one of the ribs when the display is in the erected configuration.

The present invention also provides a method of folding a collapsible display, including the steps of: pivoting affixed first and second blanks of material about their respective pivot lines, where the pivot lines separate the elongated panels of both the first and second blanks; transitioning the first and second blanks of material from a generally flat configuration to a generally erected configuration; and, then folding a series of rear shelf portions that extend from the second blank and a corresponding series of front shelf portions that extend from the front blank to form a series of shelf surfaces that each have a surface area substantially equal to a cross sectional area of the display when it is in the erected configuration.

In another embodiment, the method may also include the steps of folding the rear shelf portions that extend from the second blank from a rear of the display towards a front of the display; and, folding the front shelf portions that extend from the first blank from the front of the display towards the rear of the display.

In another embodiment, the method may also include the step of forming a frictional engagement between the rear shelf portions and the corresponding front shelf portions to maintain the rear shelf portions and front shelf portions in the series of shelf surfaces when the display is in the erected configuration.

These and other features and aspects of the present invention will be better appreciated and understood when considered in conjunction with the following description and the accompanying drawings. It should be understood, however, that the following description, while indicating representative embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
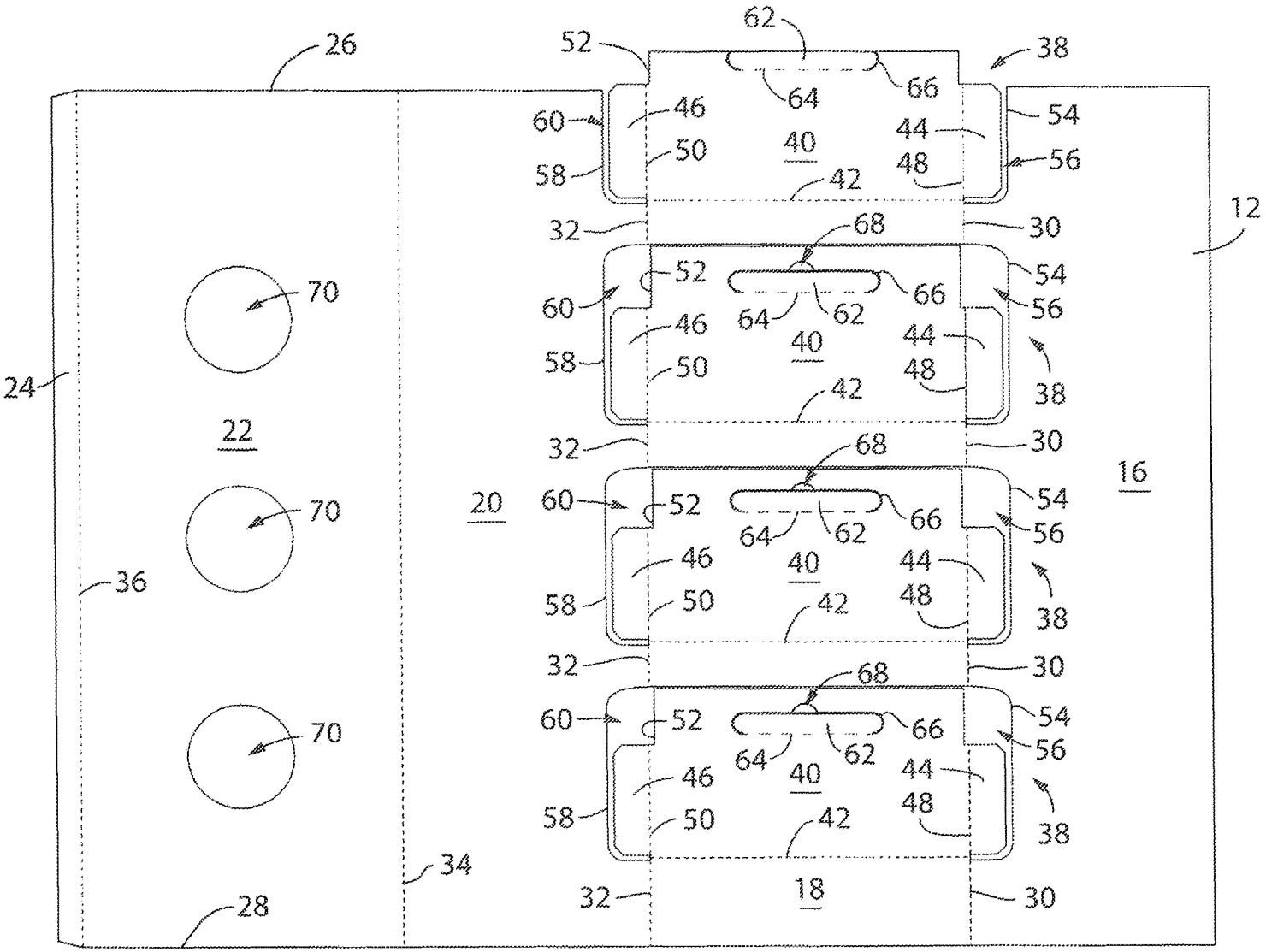
FIG. 1 is a plan view of a first blank of material in accordance with one embodiment of the present invention.

In describing the embodiments of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word "connected," "attached," or terms similar thereto are often used. They are not limited to direct connection, but include connection through other elements where such connection is recognized as being equivalent by those skilled in the art.

DETAILED DESCRIPTION

The various features and advantageous details of the subject matter disclosed herein are explained more fully with reference to the non-limiting embodiment described in detail in the following description.

Figure 2:
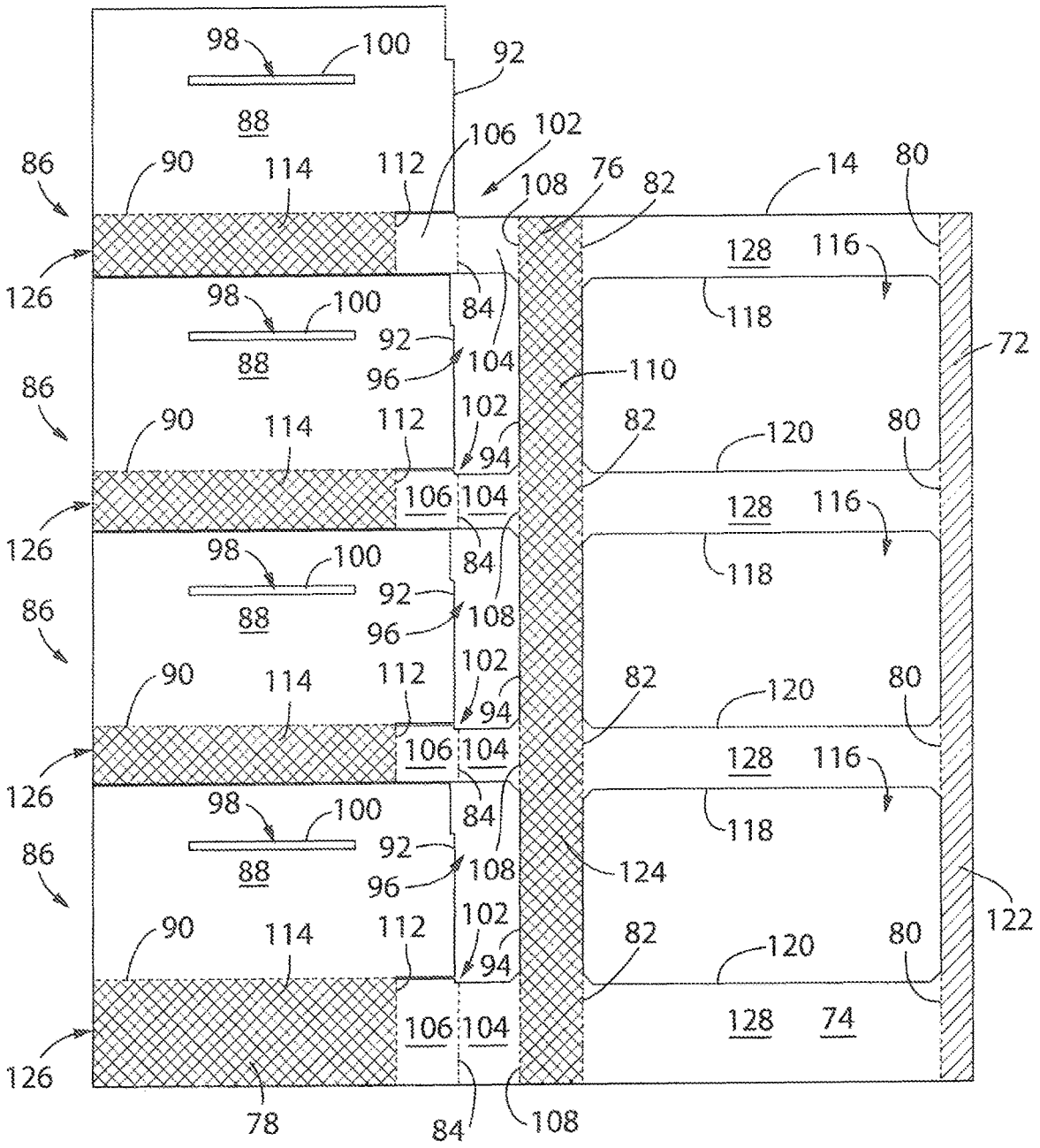
FIG. 2 is a plan view of a second blank of material in accordance with one embodiment of the present invention.
Figure 3:
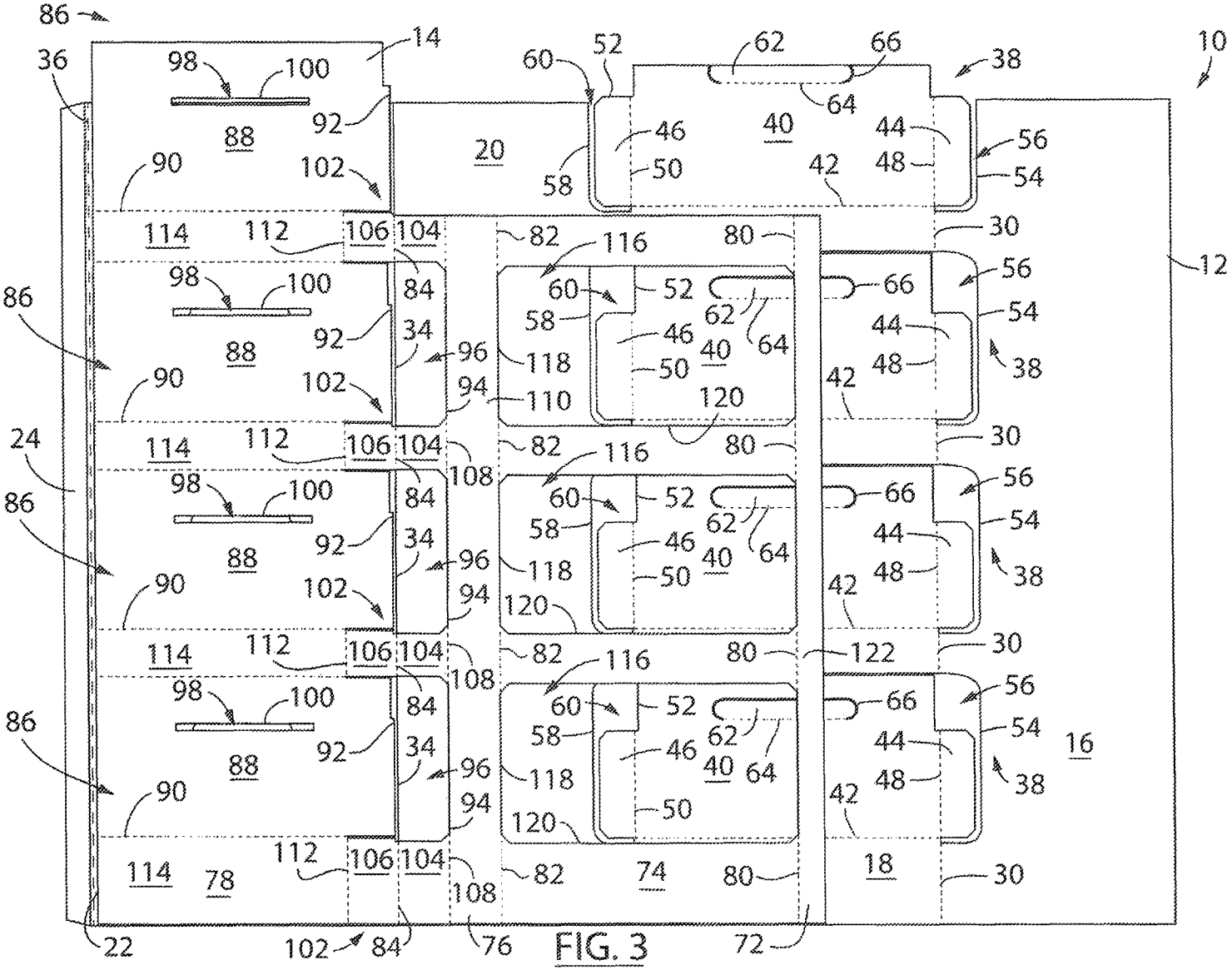
FIG. 3 is a plan view of the second blank of material of FIG. 2 overlying the first blank of material of FIG. 1 in accordance with one embodiment of the present invention.

Referring initially to FIGS. 1-3 and particularly FIG. 1, there is shown components of a display 10 according to one embodiment of the present invention. The display 10 generally is made of a first blank 12 and a second blank 14 of packaging material. The packaging material may consist of corrugated board or any similar material suitable for use in container and display construction. In a manner as is known, the corrugated board consists of a fluted corrugated core located between two sheets of kraft paper or linerboard, in a manner as is known. In one embodiment the flutes of the inner core have a longitudinal axis that is parallel to the longitudinal axis-of the folded and erected display 10. The blanks 12 and 14 may be stamped or cut from one or more sheets of the packaging material while in a substantially flat orientation, affixed to one another in a partially folded and substantially flat configuration, as will be described below, and then subsequently folded further to form the erected and assembled display 10. The outer surface of the display 10 may be printed to display information such as contents details, product information, folding instructions, orientation indicia and the like. The outer surface of the display 10 may also contain advertising information or ornamental elements.

FIG. 1 illustrates an interior view of the first blank 12, formed of a single piece of packaging material, in a flat orientation, i.e., unfolded. The blank 12 includes primarily a first side panel 16, a front panel 18, a second side panel 20 and a rear panel 22. The rear panel 22 also includes a fixation panel 24, extending from a side of the rear panel 22 along the length of the first blank 12, between the top edge 26 and bottom edge 28.

Still referring to FIG. 1, the first side panel 16 is hingedly attached to the front panel 18 about a crease line 30. The crease line 30 may be an interrupted crease line 30, as shown in FIG. 1. The opposing side of the front panel 18 is hingedly attached to the second side panel 20 about a crease line 32. Similarly, crease line 32 may also be an interrupted crease line 32, as is shown in FIG. 1. The opposing side of the second side panel 18 is hingedly attached to the rear panel 22 about line a 34. Line 34 may he a perforated line 34; however, other lines, such as score or crease lines are considered well within the scope of the present invention. The opposing side of the rear panel 22 is hingedly attached to the fixation panel 24 about a crease line 36. As illustrated in FIG. 1, the lines 30, 32, 34, and 36 are parallel in orientation, allowing the panels 16, 18, 20, 22, and 24 to he folded into a cuboid display 10 as is described in further detail below.

Still referring to FIG. 1, the front panel 18 and rear panel 22 will now be described in further detail. The front panel 18 may include a series of front shelf portions 38 disposed therein. In the illustrative embodiment of FIG. 1, four front shelf portions 38 are shown in the first blank 12. However, any number of front shelf portions 38 are considered within the scope of the present invention. Each of the front shelf portions 38 includes a front shelf panel 40 that is hingedly attached to the front panel 18 about a line 42. Line 42 may be a perforated line 42; however, other lines, such as score or crease lines as considered well within the scope of the present invention. Each front shelf portion 38 also includes opposing side panels 44 and 46, where the first side panel 44 extends from a side of the front shelf panel 40 adjacent the first side panel 16 of the first blank 12, and where the second panel 46 extends, from a side of the front shelf panel 40 adjacent the second side panel 20 of the first blank 12. The first side panel 44 of each front shelf portion 38 is hingedly attached to the corresponding front shelf panel 40 along a line 48, which is shown as a perforated line 48, but may be any other line, such as a score or crease line. Similarly, the second side panel 46 of each front shelf portion 38 is hingedly attached to the corresponding front shelf panel 40 along a line 50, which is shown as a perforated line 50, but may similarly be any other line, such as a score or crease line.

Still referring to FIG. 1, but for line 42, where the front shelf panel 40 is hingedly attached to the front panel 18, the remaining peripheral edges 52 of the front shelf panel 40 and the two opposing side panels 44 and 46 are cut from, the surrounding material of the first blank 12. Accordingly, each front shelf panel 40 and corresponding two opposing side panels 44 and 46 are allowed to independently pivot about line 42. Additionally, a cut line 54 is located adjacent and slightly removed from the first side panel 44, within the surface area of the first side panel 16 of the first blank 12. Resultantly, a void 56 is formed in the first side panel 16 of the first blank 12, which is generally located adjacent to the first side panel 44 of the front shelf portions 38. On the opposite side of the front shelf portions 38, a cut line 58 is similarly located adjacent and slightly removed from the second side panel 46, within the surface area of the second side panel 20 of the first blank 12. Resultantly, a void 60 is formed in the second side panel 20 of the first blank 12, and adjacent to the second side panel 46 of each front shelf portion 38.

Additionally, a tab 62 is disposed within the surface area of the front shelf panel 40 of each front shelf portion 38, as illustrated in FIG. 1. The tab 62 is defined by a crease line 64, extending along the bottom edge of the tab 62. The remainder of the tab 62 is defined by a cut line 66, which extends about the remaining periphery of the tab 62. As such, the tab 62 is hingedly attached to the front shelf panel 40 about the crease line 64, and may pivot about the crease line 64 accordingly. Pivoting of the tab 62 may be facilitated by a finger access void 68 located adjacent the cut line 66, which is configured to allow a user to place one or more fingers into the void 68 and engage the tab 62 in a pulling or pushing motion. The tab 62 will facilitate in securing the front shelf panel 40 to its counterpart rear shelf panel 88, formed in the second blank 14 as will be described in detail below.

As it relates to the rear panel 22 of the first blank 12, and still referring to FIG. 1, the rear panel 22 may include a series of voids 70. As illustrated in FIG. 1, the voids 70 may be of a size sufficient to allow a user to place one or more fingers, or a hand through the rear panel 22, to facilitate in assembly of the display 10 to its erected configuration. The voids 70 may be located at heights approximately equal to that of the front shelf portions 38, as to allow direct access to the shelves of the display 10. As shown in FIG. 1, a void 70 need not be placed adjacent the uppermost front shelf portions 38, which can be accessed from above the top edge 26 of the first blank 12.

Referring now to FIG. 2, the interior view of the second blank 14 of the display 10 is illustrated, formed of a single piece of packaging material, in a flat orientation. The blank 14 includes primarily a first side panel 72, a front panel 74, a second side panel 76 and a rear panel 78. The first side panel 72 is hingedly attached to the front panel 74 about a line 80. The line 80 may he a perforated line 80 and may be an interrupted line, as shown in FIG. 1. The opposing side of the front panel 74 is hingedly attached to the second side panel 76 about a line 82. Similarly, line 82 may be a perforated line 82 and may also be an interrupted line. The opposing side of the second side panel 76 is hingedly attached to the rear panel 78 about a line 84. As shown in FIG. 1, line 84 may be an interrupted or perforated line 84. As illustrated in FIG. 2, the lines 80, 82, and 84 are parallel in orientation, allowing the panels 72, 74, 76 and 78 to be folded into an incomplete cuboid when display 10 is erected during assembly, as will he described in detail below.

Still referring to FIG. 2. the rear panel 78 will now be described in further detail below. As illustrated in FIG. 2, the rear panel 78 includes a series of rear shelf portions 86 disposed therein. In the illustrative embodiment of FIG. 2, four rear shelf portions 86 are shown in the second blank 14. However, any number of rear shelf portions 86, preferably corresponding to the number of the front shelf portions, are considered within the scope of the present invention. Each of the rear shelf portions 86 may include a rear shelf panel 88 that is hingedly attached to the rear panel 78 about a line 90. Line 90 may be a perforated line 90, however, other lines, such as crease or score lines are considered well within the scope of the present invention. But for line 90, where the rear shelf panel 88 is hingedly attached to the rear panel 78, the remaining peripheral edges 92 of each rear shelf panel 88 are cut from the surrounding material of the second blank 14. Accordingly, the rear shelf panel 88 is allowed to independently pivot about line 90. Additionally, a cut line 94 is located adjacent and slightly removed from the side of each rear shelf portion 86, within the surface area of the second side panel 76 of the second blank 14. Resultantly, a void 96 is formed in the second side panel 76 of the second blank 14, adjacent the side of the rear shelf portions 86.

Furthermore, a tab receiving slot 98 is disposed within the surface area of the rear shelf panel 88 of each rear shelf portion 86, as illustrated in FIG. 2. The tab receiving slot 98 may be a narrow slot or void defined by a peripheral cut line 100, which is configured to receive the tab 62 from the corresponding front shelf panel 40 therein when the display 10 is erected in a fully assembled configuration. The tab 62 may be retained within the tab receiving slot 98 by way of frictional engagement without the use of adhesive, tape, fasteners, or the like.

Still referring to FIG. 2, adjacent each rear shelf portion 86, the rear panel 78 and the second side panel 76 cooperate to form a corner brace 102. The corner brace 102 is formed of a first corner brace panel 104 and a second corner brace panel 106. The first corner brace panel 104 is disposed within the surface of the second side panel 76, while the second corner brace panel 106 is disposed within the surface of the rear panel 78. The first corner brace panel 104 is defined between a perforated line 108, which hingedly attaches the first corner brace panel 104 to a stationary portion 110 of the second side panel 76 on one side, and line 84 on the opposing side of the first corner brace panel 104. First corner brace panel 104 is hingedly attached to the second corner brace panel 106, which is defined between line 84 on one side, and a perforated line 112, which hingedly attaches the second corner brace panel 106 to a stationary portion 114 of the rear panel 78. In use, as will be described in further detail below, when the display 10 is folded into the fully assembled and erected configuration, the first and second corner brace panels 104, 106, respectively, each pivot inwardly, relative to the second wall panel 76 and rear panel 78 of the second blank 14. Specifically, the first corner brace panel 104 pivots inwardly approximately 90°, relative to the stationary portion 110 of the second side panel 76, while the second corner brace panel 106 pivots inwardly approximately 90°, relative to the stationary portion 114 of the rear panel 78. As such, once erected the first corner brace panel 104 is generally parallel to the rear panel 78, and the second corner brace panel 106 is generally parallel to the second side panel 76, with the upper edges of the corner brace 102 providing a supporting surface upon which the rear shelf panel 88 engages and rests.

Turning now to the front panel 74 of the second blank 14, and still referring to FIG. 2, the front panel 74 may include a series of voids 116. As illustrated in FIG. 2, the voids 116 may be of a size sufficient to allow the front shelf portion 40 and/or rear shelf portion 86 to pass through the void 116, while the display is transitioning from a flat configuration to an erected configuration, and back again. As shown in FIG. 2, each void 116 is cut out of the front panel 74 along a cut line 118, where a lower edge 120 of the cut line 118 is located approximately even with the upper surface of the adjacent corner brace 102. Accordingly, when the display 10 is in a fully assembled and erected configuration, the lower edge 120 of the cut line 118 may extend across the width of the display 10 and provide a supporting surface upon which the rear shelf panel 88 engages and rests. That is to say that the areas of the front panel 74, which remain between the intermittent voids 116 form ribs 128, upon which the rear shelf panel 88 engages and rests. Furthermore, each tab 62 that extends through a corresponding tab receiving slot 98 may also engage corresponding ribs 128 formed of the front panel 74 of the second blank 14. As will be described below, the ribs 128 are asymmetrically positioned below the surface area of the shelf surfaces 130 relative to the depth of the shelf surfaces 130, when the display 10 is folded into its erected configuration. That is to say that the position of the ribs 128 does not symmetrically bifurcate the depth of the shelf surfaces 130, and in one representative embodiment is positioned closer to the rear panel than the front panel 74, when the display 10 is in its fully assembled and erected configuration.

Finally, in reference to FIG. 2, the second blank 14 may include one or more adhesive areas disposed thereon. A. first adhesive area 122 is disposed on the upper surface of the first side panel 72, as designated by the diagonal shading or hatching in FIG. 2. That is to say, as FIG. 2 illustrates the interior view of the second blank 14 of the display 10, the first adhesive area 122 is located at the interior surface of the second blank 14. When the display 10 is assembled in its flat configuration, the interior surface of the first side panel 16 of the first blank 12 will be folded over the second blank 14 and engage first adhesive area 122, as will be subsequently shown and described in further detail. A second adhesive area 124 is disposed on the under surface of the stationary portion 110 of the second side panel 76 of the second blank 14 as designated by the cross hatching in FIG. 2, That is to say, as FIG. 2 illustrates the interior view of the second blank 14 of the display 10, the second adhesive area 124 is orated at the underside of the second blank 14. When the display 10 is assembled in its flat configuration, the interior surface of the second side panel 20 of the first blank 12 will receive the under surface of the second blank 14 and engage second adhesive area 124. A series of third adhesive areas 126 are similarly disposed on the under surface of the stationary portion 114 of the rear panel 78 of the second blank 14, and designated by the cross hatching in FIG. 2. When the display 10 is assembled in its flat configuration, the interior surface of the rear panel 22 of the first blank 12 will receive the under surface of the second blank 14 and engage second adhesive areas 126. While the adhesive areas 122, 124, 126 have been described in the context of adhesive, the use of other fixation forms such as fasteners are considered within the scope of the present invention.

Turning now to FIG. 3, the second blank 14, as was described above, is shown overlying the first blank 12, as was also described above. In this overlying orientation, the second adhesive area 124 and the series of third adhesive areas 126 have attached the first and second blanks 12, 14 together. As such, FIG. 3 illustrates the relative positions of the first and second blanks 12, 14 in a substantially flat and partially assembled configuration.

Figure 4A:
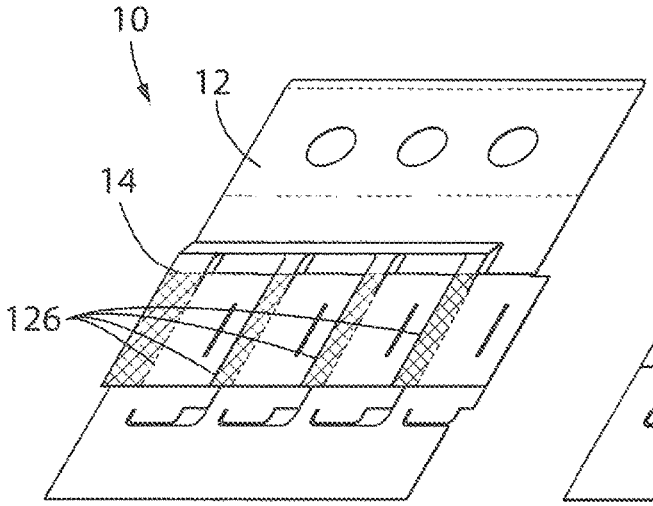
FIG. 4A is a perspective view of the second blank of material of FIG. 2 partially engaging and affixed to the first blank of material of FIG. 1 in accordance with a step-wise assembly of one embodiment of the present invention.
Figure 4B:
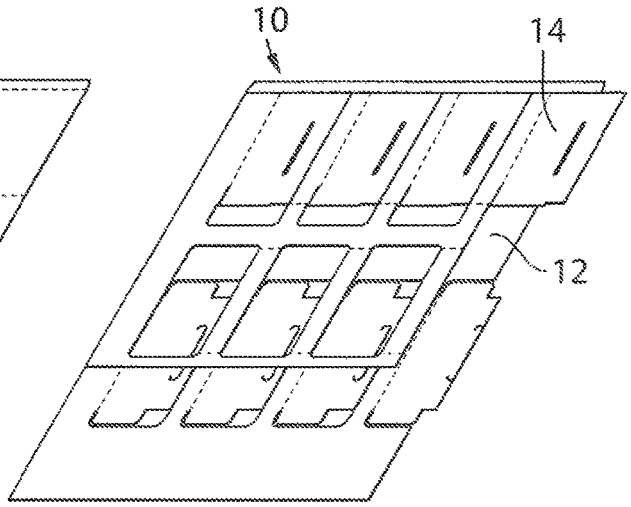
FIG. 4B is a perspective view of the second blank of material of FIG. 2 fully engaging and affixed to the first blank of material of FIG. 1 in accordance with a step-wise assembly of one embodiment of the present invention.
Figure 4C:
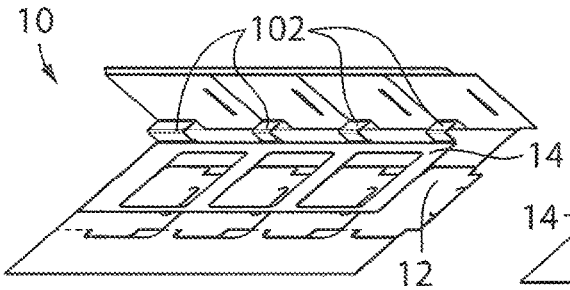
FIG. 4C is a perspective view of a first end portion of the second blank of material and a first end portion of the first blank of material folded partially inward in accordance with a step wise assembly of one embodiment of the present invention.
Figure 4D:
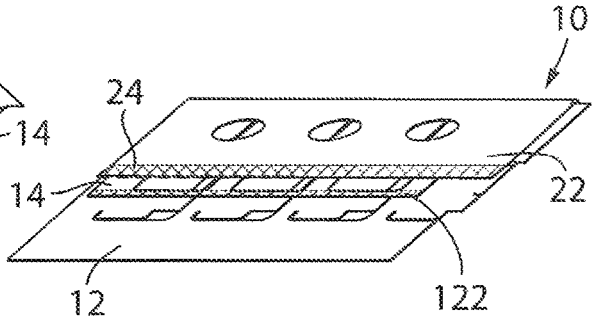
FIG. 4D is a perspective view of the first end portion of the second blank of material and the first end portion of the first blank of material being fully folded inward in accordance with a step-wise assembly of one embodiment of the present invention.
Figure 4E:
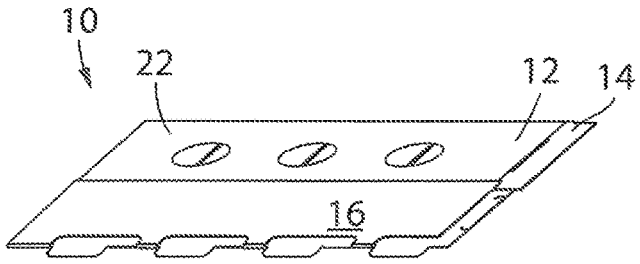
FIG. 4E is a perspective view of a second end portion of the first blank of material being fully folded inward to engage and affix to the inwardly folded first end portion of the first blank of material in accordance with a step-wise assembly of one embodiment of the present invention.

Turning now to FIGS. 4A through 4I, the display 10 according to the present invention is shown in various steps of assembly. Beginning with FIG. 4A, the second blank 14 is shown partially affixed to the first blank 12 at the second adhesive area 124 (not shown) and where the second blank 14 has been folded to expose the underside of the second blank 14 and its series of third adhesive areas 126. In FIG. 4B, the underside of the second blank 14 has been laid flat against the interior surface of the first surface of the first blank 12, such that the third adhesive areas 126 have been adhesively affixed to the first blank 12, in a manner consistent with that illustrated in FIG. 3. In FIG. 4C, the adhesively affixed rear panels 22, 78 of the first and second blanks 12, 14, respectively, are folded about their respective lines 34, 84, which results in the inward rotation and extension of the corner braces 102, as shown. In subsequent FIG. 4D, adhesive is applied second blank 14 at first adhesive area 122, i.e. on the upper surface of the first side panel 72 of the second blank 14, as well as to the outer surface of the fixation panel 24, extending from the side of the rear panel 22 of the first blank 12. Next, in FIG. 4E, the first side panel 16 of the first blank 12 is folded over, where it engages and becomes adhesively affixed to both the first adhesive area 122 of the second blank 14 and the fixation panel 24 of the first blank 12. At this step in assembly of the display 10, the first and second blanks 12, 14 have been assembled to form display 10 in its substantially flat configuration, which is particularly well suited for shipping and/or storage of the display 10.

Figure 4F:
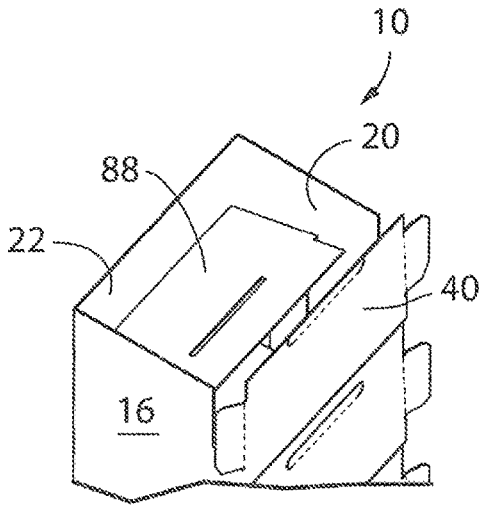
FIG. 4F is a perspective view of a rear shelf panel being folded inwardly in accordance with a step-wise assembly of one embodiment of the present invention.
Figure 4G:
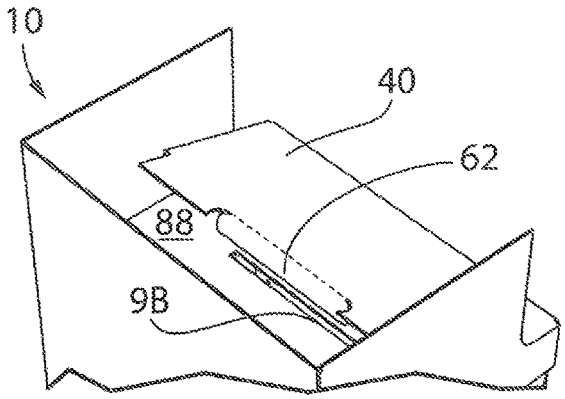
FIG. 4G is a perspective view of a front shelf panel being folded inwardly and engaging a folded rear shelf panel in accordance with a step-wise assembly of one embodiment of the present invention.
Figure 4H:
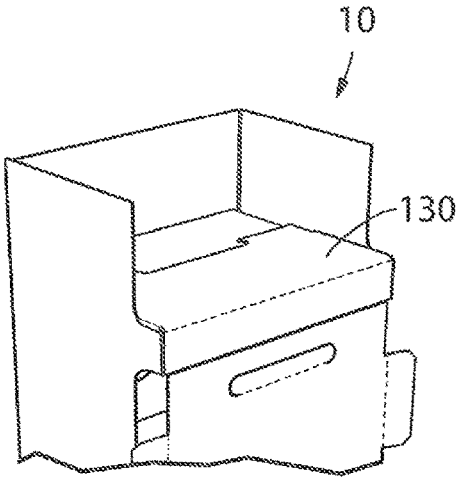
FIG. 4H is a perspective view of a folded shelf comprising both a folded front shelf panel and rear shelf panel in accordance with a step-wise assembly of one embodiment of the present invention.
Figure 4I:
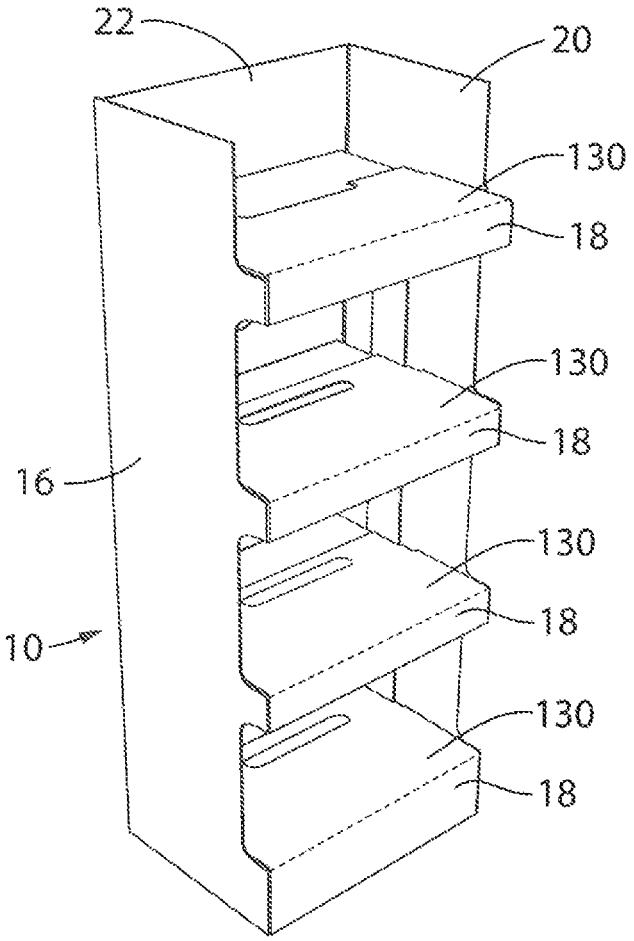
FIG. 4I is a perspective view of a folded and erected display in accordance with one embodiment of the present invention.

In subsequent FIGS. 4F-4I, the display 10 is shown in various steps during the process of folding the display 10 into its full-assembled and erected configuration. As one example of folding the series of front and rear shelf portions 38, 86, FIG. 4F shows the folding of a top most front and rear shelf portion 38, 86, respectively. Specifically, FIG. 4F shows the rear shelf panel 88 of the rear shelf portion 86 first being folded down, until the lower surface of the rear shelf panel 88 engages both the upper edge of the corresponding corner brace 102 as well as the lower edge 120 of the cut line 118, which forms a rib 128 to support the rear shelf panel 88. Turning now to FIG. 4G, the corresponding front shelf panel 40 of the front shelf portion 36 is folded downward, and the tab 62 is directed into the tab receiving slot 98 that is located in the rear shelf panel 88. In FIG. 4H, the rear shelf panel 88 is shown folded into a frictional engagement with the front shelf panel 40 to form a shelf surface 130 that extends generally across the cross sectional area of the display 10. In FIG. 4I, the series of rear shelf panels 88 are shown folded into frictional engagement with their corresponding front shelf panels 40 to form a series of shelf surfaces 130 that extend generally throughout the cross sectional area of the display 10, and represent the display 10 in its fully assembled and erected configuration.

FIGS. 5-13 are provided herewith to illustrate the above described display 10 in both a folded and an erected configuration, in further detail.

Figure 5:
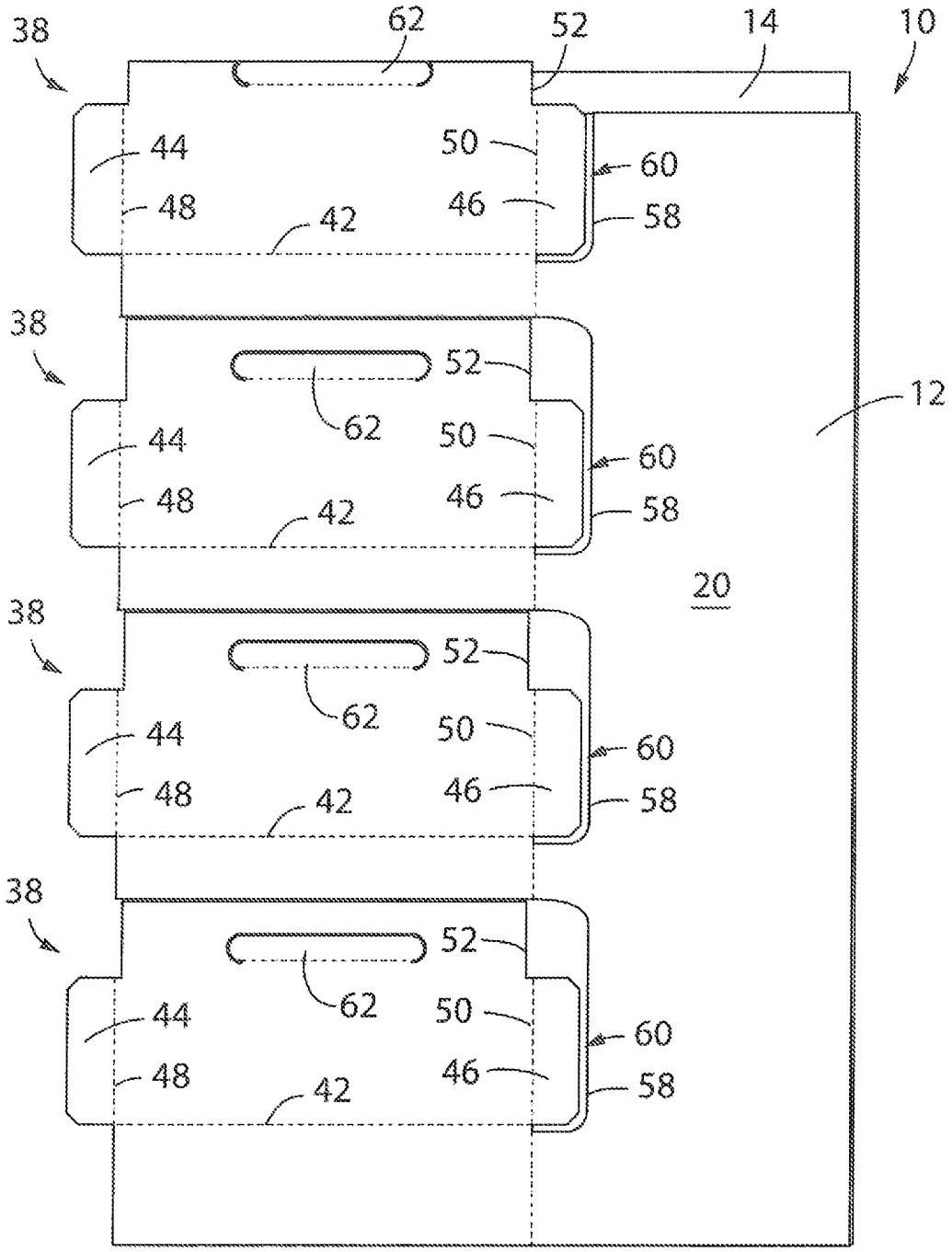
FIG. 5 is a front plan view of the first blank of FIG. 1 engaging and affixed to the second blank of FIG. 2 in a substantially flat configuration of the display in accordance with one embodiment of the present invention.
Figure 6:
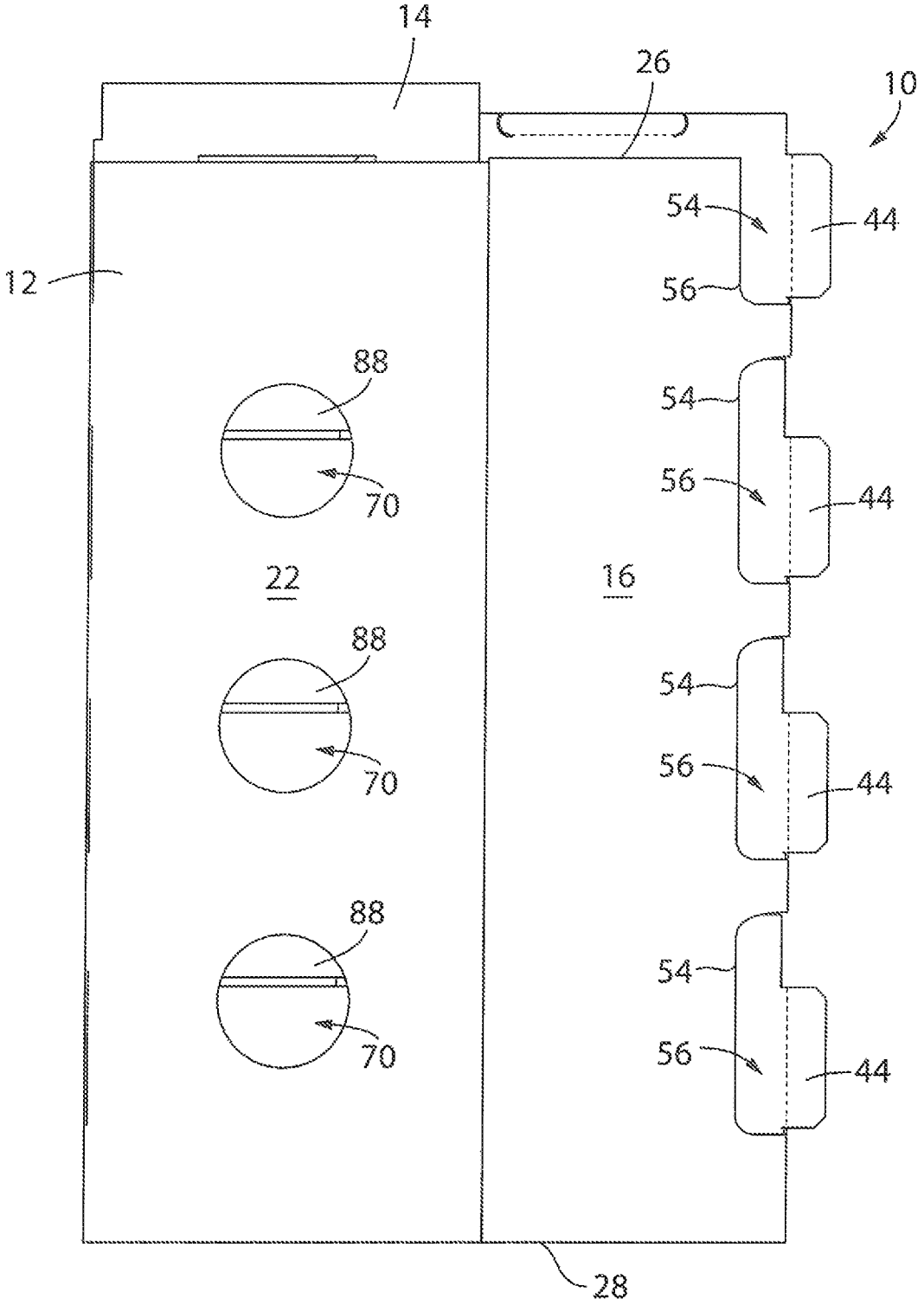
FIG. 6 is a rear plan view of the first blank of FIG. 1 engaging and affixed to the second blank of FIG. 2 in a substantially flat configuration of the display in accordance with one embodiment of the present invention.

Specifically, FIG. 5 shows the substantially flat configuration of the display 10, wherein the first and second blanks 12, 14 have been adhesively affixed to one another. In FIG. 5, the outer surface of the front panel 18 and the second side panel 20 of the first blank 12 are shown in a configuration that is particularly well suited for shipping and/or storage of the display 10. In this generally flat folded configuration the first side panel 44 of each front shelf portion 38 is shown extending outwardly at the side of the display 10. FIG. 6 shows the reverse side of the display 10, in the substantially flat configuration as was shown in FIG. 5. In this view, the series of circular voids 70 are shown in the rear panel 22 of the first blank 12. Through the voids 70, the rear shelf panels 88 are shown, indicating that the voids 70 allow direct access to the shelves of the display 10 and may be utilized to provide access during assembly.

Figure 7:
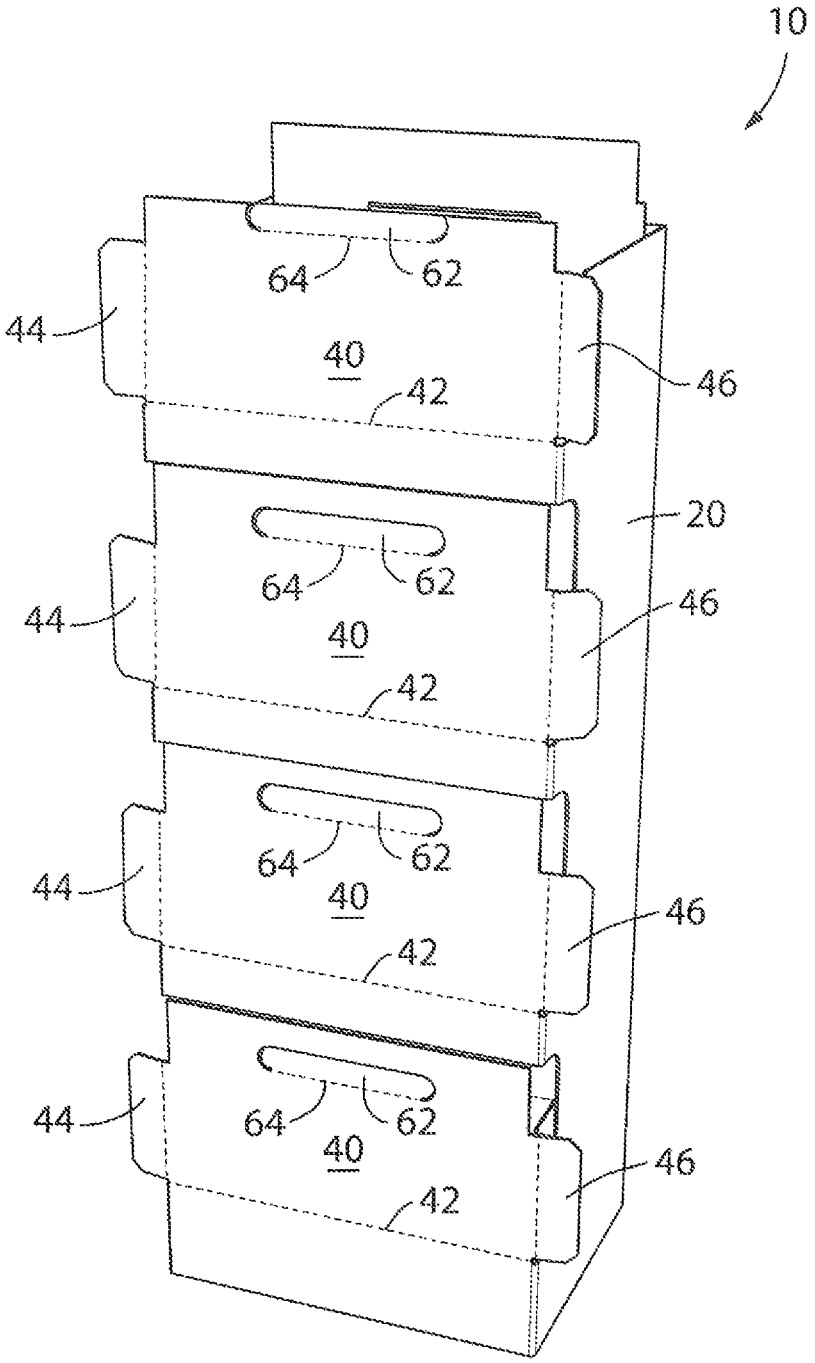
FIG. 7 is a front perspective view of the first and second blanks in an erected configuration of the display in accordance with one embodiment of the present invention, in which the series of shelf panels have not been folded to form shelves.
Figure 8:
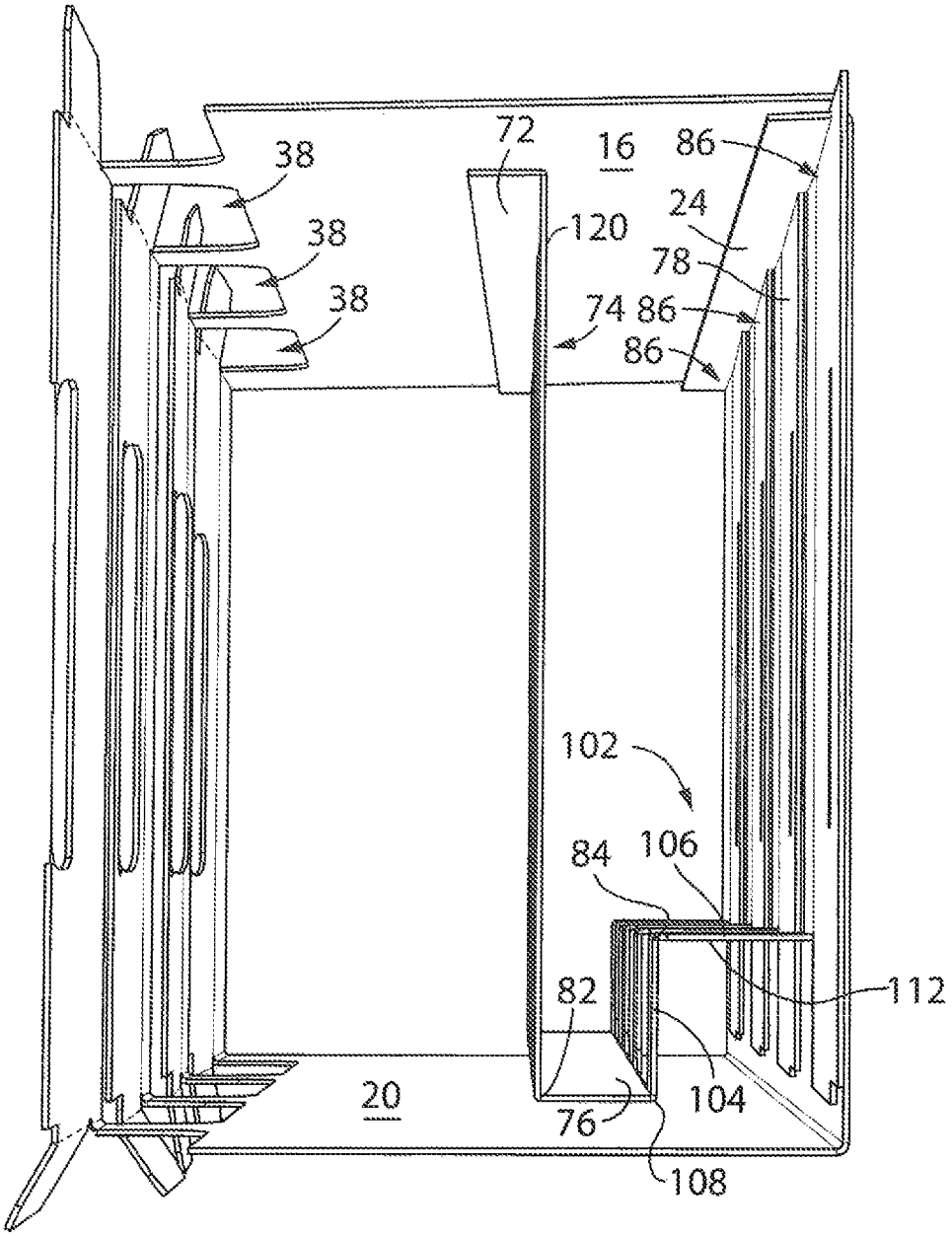
FIG. 8 is a top isometric view of the first and second blanks in an erected configuration of the display in accordance with one embodiment of the present invention, in which the series of shelf panels have not been folded to form shelves.

Turning to FIG. 7, the display 10 is shown in a partially folded configuration where the first blank 12 has been rotated about its respective lines 30, 32, 34, and 36 as to allow the panels 16, 18, 20, 22, and 24 to he folded into a cuboid display 10 as shown. Simultaneously, the second blank 14 has been folded about lines 80, 82, and 84 as to allow its corresponding panels 72, 74, 76 and 78 to be folded into an incomplete cuboid, when display 10 is erected during assembly. The second blank 14 and its panels are not shown in FIG. 7 as they are blocked from view by way of being located within the interior of the first blank 12. However, FIG. 8 shows a top perspective view of the display 10 in its partially folded configuration as was previously shown in FIG. 7. In this view, the second blank 12 can be seen with its series of ribs 128 and corner braces 102 extending into the interior of the display 102 before the shelves are folded downwardly.

Figure 9:
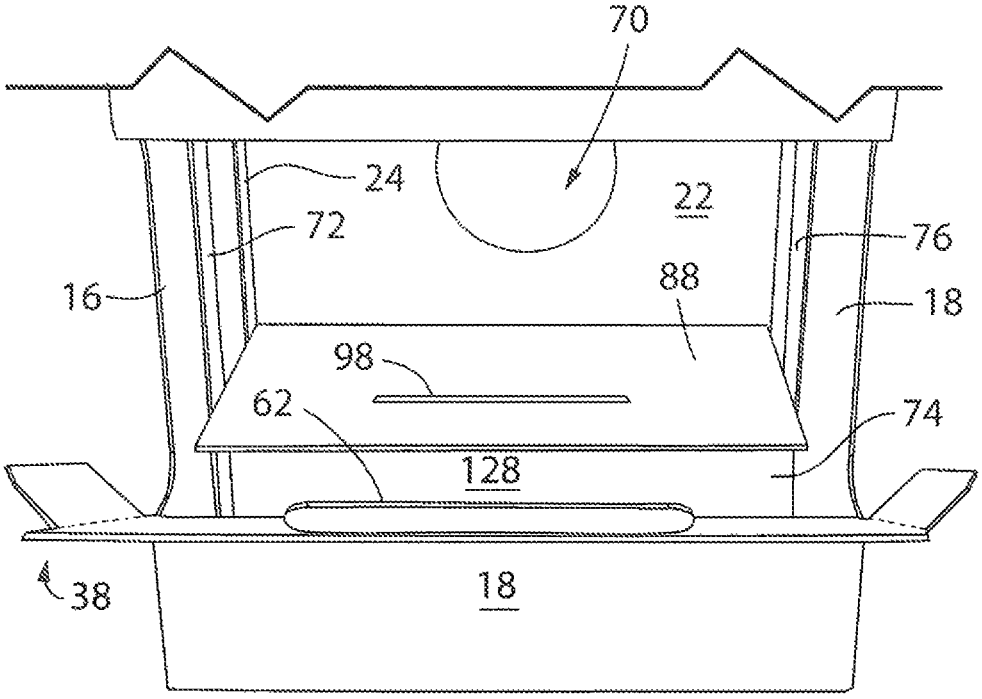
FIG. 9 is a front isometric view of the first and second blanks in an erected configuration of the display in accordance with one embodiment of the present invention, in which a shelf panel of the second blank has been folded.
Figure 10:
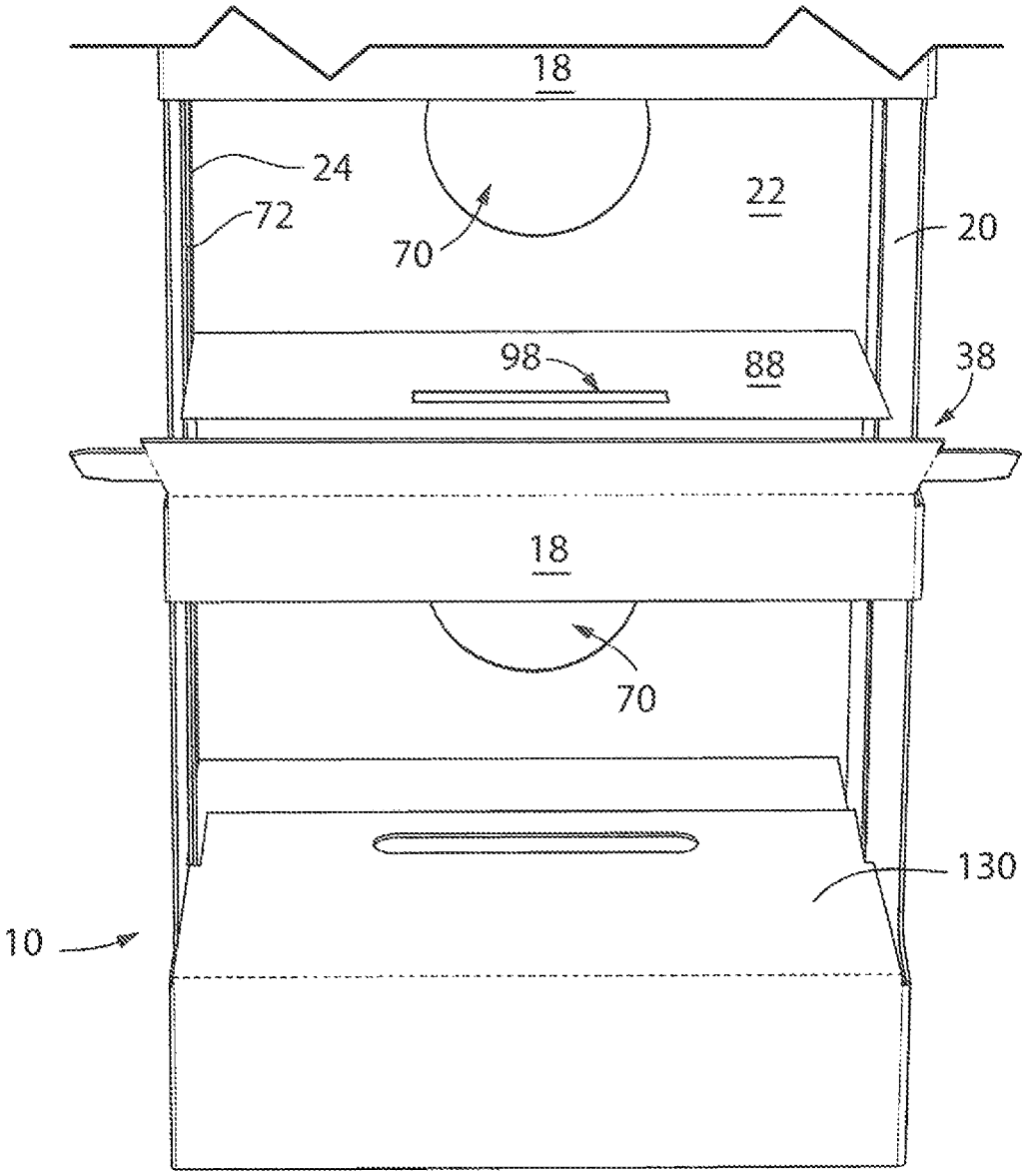
FIG. 10 is a front isometric view of the first and second blanks in an erected configuration of the display in accordance with one embodiment of the present invention, in which a shelf panel of the first blank has been folded and engages the folded shelf panel of the second blank of FIG. 9.
Figure 11:
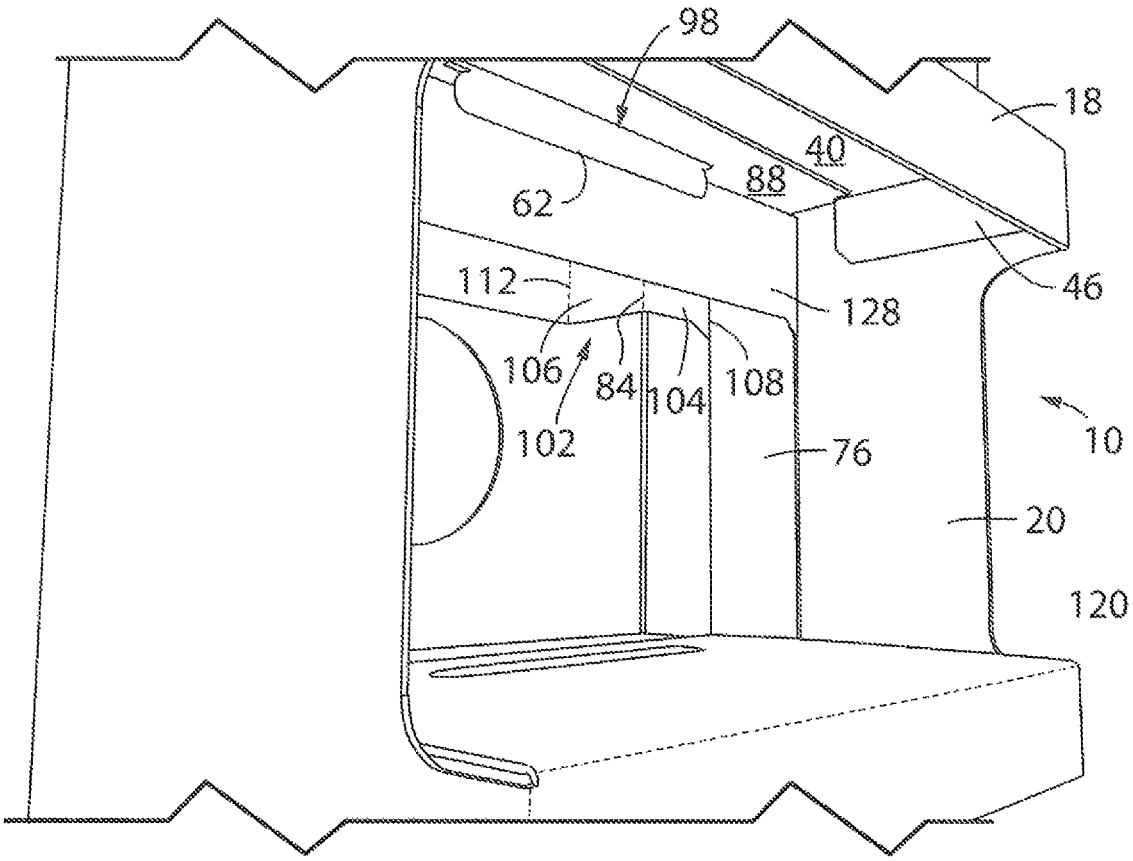
FIG. 11 is a perspective view of a folded and erected display in accordance with one embodiment of the present invention.
Figure 12:
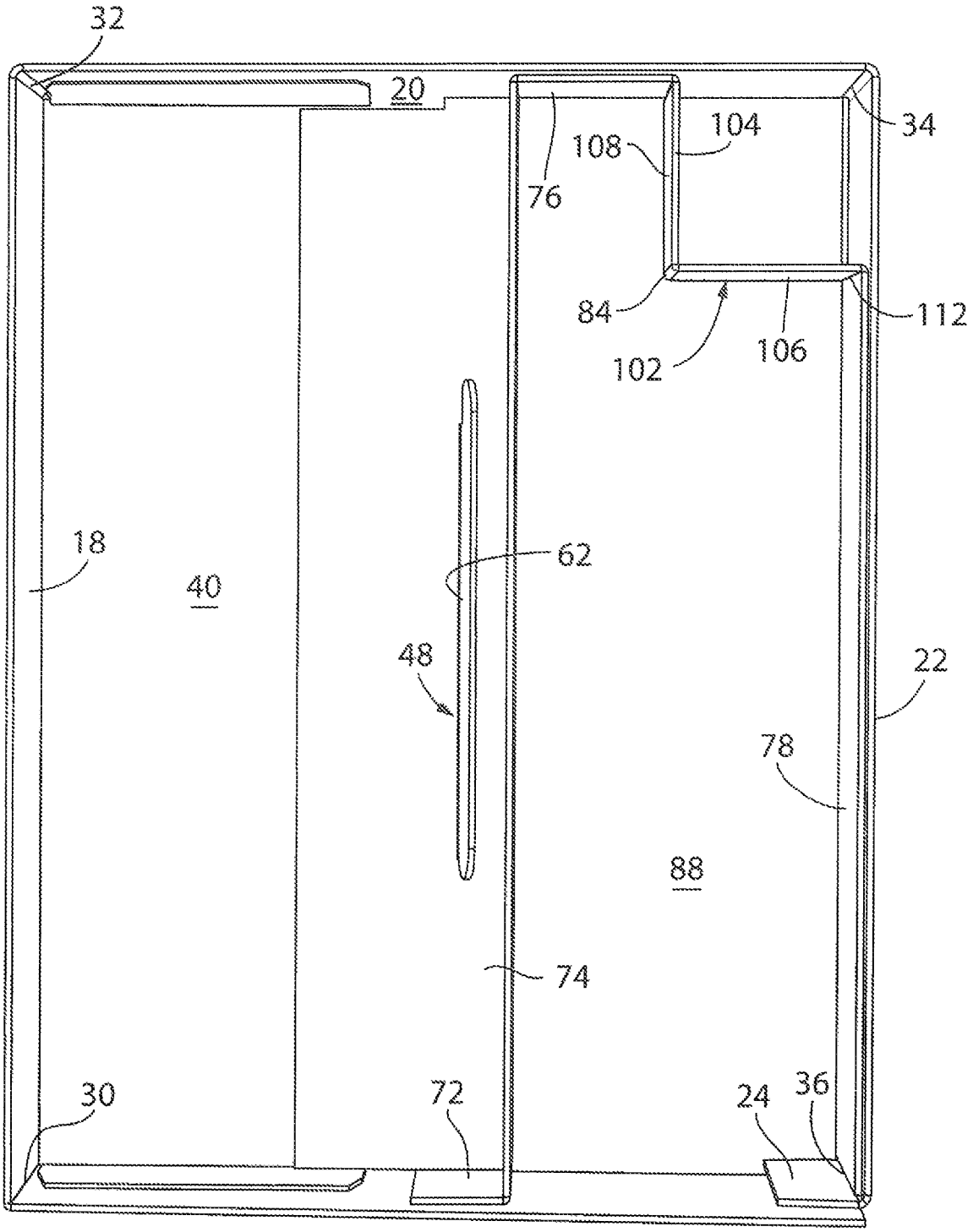
FIG. 12 is a bottom front perspective view of an assembled shelf of the erected display in accordance with one embodiment of the present invention.

Turning now to FIGS. 9 and 10, the bottom shelf surface 130 is shown in detailed assembly, wherein FIG. 9 shows an initial step of folding the rear shelf panel 88 downward until it engages its corresponding rib 128 and corner brace 102, and FIG. 10 shows the subsequent step of folding the front shelf panel 38 downward until its tab 62 is received within the receiving slot 98 to form the shelf surface 130. As viewed from the bottom in FIGS. 11 and 12, the tab 62 is shown received within the receiving slot 98 and in frictional engagement with the rib 128, as to prevent the shelf surface 130 from inadvertently becoming separated. Furthermore, the underside of the shelf surface 130 is shown engaging both the corresponding rib 128 and corner brace 102, as to provide structural support to the shelf surface 130.

Figure 13:
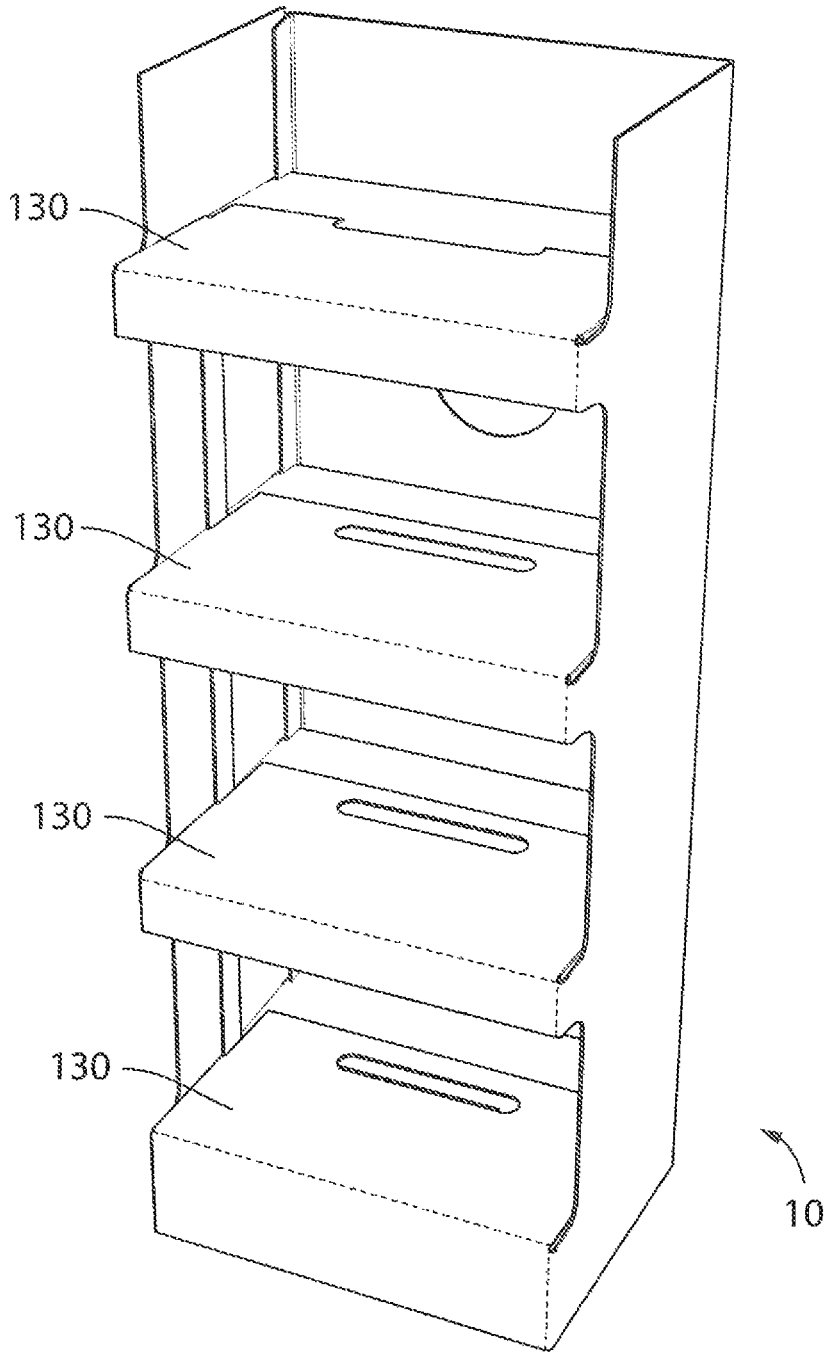
FIG. 13 is a bottom isometric view of the erected display in accordance with one embodiment of the present invention.

Finally, FIG. 13 shows the display 10 in which each of the shelf surfaces 130 have been folded into their assembled configuration in a step wise manner as shown in FIGS. 9 and 10. Accordingly, FIG. 13 shows the display in a fully assembled and erected configuration.

Although a specific embodiment is illustrated and discussed above, it is understood that the size and shape of the display 10 may vary greatly to accommodate space requirements and the size and shape of products to be displayed on the shelf surfaces 130. While the figures have illustrated display 10 approximately having a height of 50 inches, a width of 18 inches and a depth of 13 inches, larger or smaller displays 10 are considered well within the scope of the present invention. Similarly, any number, location, variation or combination in the multiple styles of shelf panels, braces and crease lines described herein is considered within the scope of the present invention.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

We claim:

1. A collapsible display, having:

a first blank of material defining a plurality of outer panels of the display and a plurality of front shelf portions;

the first blank affixed to a second blank of material, wherein the second blank of material defines a plurality of rear shelf portions; and wherein the first and second blanks of material are affixed to each other and are configured to transition the display from a generally flat configuration to an erected configuration, wherein when the display is in the erected configuration the rear shelf portions face upwardly and extend forwardly from a rear area of the display and the front shelf portions respectively face upwardly and extend rearwardly from a front area of the display and engage corresponding rear shelf portions, and wherein the respective front shelf portions and rear shelf portions cooperate to define a plurality of upwardly facing shelf surfaces, the shelf surfaces having a surface area substantially equal to a cross sectional area of the display in the erected configuration.

2. A collapsible display, having:

a first blank of material defining a plurality of outer panels of the display and a plurality of front shelf portions;

the first blank affixed to a second blank of material, wherein the second blank of material defines a plurality of rear shelf portions; and wherein the first and second blanks of material are affixed to each other and are configured to transition from a generally flat configuration to an erected configuration, wherein the front shelf portions respectively engage corresponding rear shelf portions to define a plurality of shelf surfaces, the shelf surfaces having a surface area substantially equal to a cross sectional area of the display in the erected configuration, and wherein the second blank of material further defines a plurality of collapsible corner braces.

3. The collapsible display of claim 2, wherein an upper edge of each collapsible corner brace is configured to engage a lower surface of a corresponding rear shelf portion when in the erected configuration.

4. The collapsible display of claim 2, wherein each corner brace extends inwardly from a rear panel and an adjacent side panel of the collapsible display when in the erected configuration, wherein the rear panel and the adjacent panel are defined by the first blank of material.

5. The collapsible display of claim 4, wherein each corner brace extends approximately perpendicular to the rear panel and the adjacent side panel of the collapsible display when in the erected configuration.

6. A collapsible display, having:

a first blank of material defining a plurality of outer panels of the display and a plurality of front shelf portions;

the first blank affixed to a second blank of material, wherein the second blank of material defines a plurality of rear shelf portions; and wherein the first and second blanks of material are affixed to each other and are configured to transition from a generally flat configuration to an erected configuration, wherein the front shelf portions respectively engage corresponding rear shelf portions to define a plurality of shelf surfaces, the shelf surfaces having a surface area substantially equal to a cross sectional area of the display in the erected configuration, and wherein the second blank of material further defines a plurality of ribs extending from a first side of the display to an opposing second side of the display.

7. The collapsible display of claim 6, wherein an upper edge of each rib is configured to engage a lower surface of a corresponding rear shelf portion when in the erected configuration.

8. The collapsible display of claim 7, wherein each front shelf portion includes a tab extending therefrom and each rear shelf portion includes a void, and wherein the tab extending from one of the front shelf portions passes through the void in the corresponding rear shelf portion.

9. The collapsible display of claim 6, wherein the first blank defines a rear panel and a front panel separated by a depth, and wherein the plurality of ribs are asymmetrically positioned between the rear panel and the front panel relative to the depth between the rear panel and the front panel.

10. The collapsible display of claim 1, wherein the first and second blanks of material are formed of a corrugated material.

11. The collapsible display of claim 1, wherein the first blank of material is adhesively affixed to the second blank of material.

12. The collapsible display of claim 1, further comprising a rear outer panel of the first blank having one or more voids, wherein the one or more voids are configured to provide access to the plurality of rear shelf portions when the display is in the erected configuration.

13. The collapsible display of claim 1, wherein the plurality of outer panels of the display include a first side panel, an opposing second side panel, and a front panel extending between the first and second side panels, wherein the first and second side panels each comprise a series of voids adjacent the front panel.

14. The collapsible display of claim 13, wherein the series of voids in the first and second side panels are generally disposed between the front shelf portions.

15. A shelving display, having:

a first blank of material comprising a front panel, a rear panel, a first side panel extending between the front panel and the rear panel, an opposing second side panel extending between the front panel and the rear panel, and a plurality of front shelf portions;

the first blank affixed to a second blank of material, wherein the second blank of material defines a plurality of rear shelf portions, a plurality of collapsible corner braces, and a plurality of ribs extending generally from the first side panel to the opposing second side panel; and wherein the front shelf portions respectively engage corresponding rear shelf portions to define a plurality of shelf surfaces, the shelf surfaces having a surface area substantially equal to a cross sectional area of the display in the erected configuration.

16. The shelving display of claim 15, wherein the shelving display is configured to transition between a generally flat configuration and an erected configuration.

17. The shelving display of claim 16, wherein an upper edge of each collapsible corner brace is configured to engage a lower surface of a corresponding rear shelf portion when the shelving display is in the erected configuration.

18. The shelving display of claim 16, wherein an upper edge of each rib is configured to engage a lower surface of a corresponding rear shelf portion when the shelving display is in the erected configuration.

19. The shelving display of claim 16, wherein each front shelf portion includes a tab extending therefrom and each rear shelf portion includes a void, and wherein the tab extending from one of the front shelf portions passes through the void in the corresponding rear shelf portion.

20. The collapsible display of claim 15, wherein the first blank defines a rear panel and a front panel separated by a depth, and wherein the plurality of ribs are asymmetrically positioned between the rear panel and the front panel relative to the depth between the rear panel and the front panel.

21. A method of folding a collapsible display, comprising the steps of:

pivoting a first and second blank of material about respective pivot lines, wherein the first blank comprises a plurality of elongated outer panels that are separated by the pivot lines and the second blank comprises a plurality of elongated inner panels that are separated by the pivot lines, and wherein the second blank is affixed within the first blank;

transitioning the first and second blank of material from a generally flat configuration to a generally erected configuration;

folding a series of rear shelf portions that extend from the second blank and a corresponding series of front shelf portions that extend from the first blank to form a series of shelf surfaces having a surface area substantially equal to a cross sectional area of the display in the erected configuration.

22. The method of claim 21, wherein the step of forming the series of shelf surfaces further comprises:

folding the rear shelf portions that extend from the second blank from a rear of the collapsible display towards a front of the collapsible display;

folding the front shelf portions that extend from the first blank from the front of the collapsible display towards the rear of the collapsible display;

forming a frictional engagement between the rear shelf portions and the corresponding front shelf portions to maintain the rear shelf portions and front shelf portions in the series of shelf surfaces when the display is in the erected configuration.

* * * * *